United States Patent [19]

Ostrander

[11] Patent Number: 4,925,088

[45] Date of Patent: May 15, 1990

[54] PACKAGING CONTAINER

[75] Inventor: Charles Ostrander, Bexley, Ohio

[73] Assignee: R. G. Barry Corporation, Pickerington, Ohio

[21] Appl. No.: 403,369

[22] Filed: Sep. 6, 1989

[51] Int. Cl.[5] ..... B65D 5/10

[52] U.S. Cl. ..... 229/120.12; 206/45.14; 206/45.31; 229/120.17; 229/162

[58] Field of Search ..... 229/120.03, 120.12, 229/120.17, 162; 206/45.14, 45.19, 45.31, 45.34

[56] References Cited

U.S. PATENT DOCUMENTS

| | | | |
|---|---|---|---|
| 1,084,851 | 1/1914 | Ford | 229/120.12 |
| 2,170,906 | 8/1939 | Mertz | 229/162 |
| 2,611,529 | 9/1952 | Currivan | 229/120.12 |
| 2,643,811 | 6/1953 | Bolding | 229/120.12 |
| 3,125,277 | 3/1964 | Kozlowski | 229/120.12 |
| 3,182,792 | 5/1965 | Viltrakis | 229/120.12 |
| 3,680,687 | 8/1972 | D'Alessio | 229/120.12 |
| 3,747,831 | 7/1973 | Hanson | 229/120.12 |
| 3,786,622 | 6/1965 | Palmer | 229/120.03 |
| 3,853,259 | 12/1974 | Tupper | 229/120.12 |

FOREIGN PATENT DOCUMENTS

| | | | |
|---|---|---|---|
| 129114 | 12/1984 | European Pat. Off. | 229/120.12 |
| 2035959 | 6/1980 | United Kingdom | 229/162 |

*Primary Examiner*—Gary Elkins

*Attorney, Agent, or Firm*—Watson, Cole, Grindle & Watson

[57] ABSTRACT

A packaging container having a construction which makes it particularly adaptable for displaying various articles to enhance their appearance and therefore their marketability. The packaging container comprises a front wall, a back wall, a top wall, a bottom wall and two end walls joined to each other to form an enclosure of a generally rectangular configuration. The front wall and the top wall have an contiguous opening therein for display of one or more articles contained within the enclosure. The container further includes a slanted shelf extending from adjacent the edge between the top wall and the back wall to an area adjacent the edge between the front wall and the bottom wall.

17 Claims, 2 Drawing Sheets

PACKAGING CONTAINER

BACKGROUND OF THE INVENTION

The present invention relates generally to a construction for packages and, more particularly, to a construction for packaging container which is adaptable to serve as a display package for various articles to enhance their appearance and therefore the marketability of the articles by providing an attractive presentation for the articles.

In the retail merchandising of products to customers, it has been long found that the sales volume of these products is generally enhanced if the particular product being offered for sale is attractively presented to the customer at the point of sale. Many constructions for packaging containers are known for this purpose and one particularly popular construction is a generally rectangularly shaped container for enclosing the product which has a fairly large opening or window therein so the product or a portion thereof can be viewed from the exterior by the prospective customer. Attractiveness of the packaging may be further enhanced if the opening is covered with a sheet of transparent material to give the appearance of a glass-paned window.

It has also been recognized in merchandising that an unusual type packinging can act as a so-called "eye-catcher" for casual shoppers who may not have any intention of purchasing a particular article but due to the attractive manner in which the article is presented in its packaging, interest in the article may be stimulated and an impulse purchase may be the result. Such packaging for articles may take many forms but the most common basically functional form is a generally rectangular container which also serves to protect the article from damage and soiling and basically conforms to the general shape of the article or articles contained therein. It is desirable to have one packaging container for articles and products which could be used to both enhance the display appearance of the articles as well as serving the basic function of a package for protection of the articles both during transportation and storage and at the point or points of sale.

SUMMARY OF THE INVENTION

It is therefore a feature of the present invention to provide a construction for a packaging container which serves as an attractive display package to enhance the appearance of an article contained therein so as to help improve sales of the contained product or article.

It is another feature of the present invention to provide a construction for an packaging container which incorporates a slanted or angled shelf for enhancing the display of the article or product contained in the package, particularly by presenting the article in its most attractive position when viewed by a potential customer.

It is yet another feature of the present invention to provide a construction for a packaging container which incorporates a slanted and display shelf which enables a companion item or article to the one being displayed such as the other half of a pair or set to be concealed from view in the same container yet be readily accessible should the need arise.

It is also a feature of the present invention to provide a packaging container which can be easily and simply constructed from an integral blank capable of being produced on conventional fiberboard or pasteboard box and container forming equipment.

Briefly, in its broader aspects, the present invention comprehends a packaging container comprising a front wall, aback wall, a top wall, a bottom wall and two end walls joined or secured to each other to form an enclosure of a generally rectangular configuration, the front wall and the top wall having an contiguous opening therein for display of one or more articles contained within the enclosure, the container further including a slanted shelf extending from adjacent the edge between the top wall and the back wall to an area adjacent the edge between the front wall and the bottom wall.

The present invention further comprehends a packaging container comprising a top wall, a bottom wall, a front wall and a back wall secured to each other to form an enclosure of a generally rectangular configuration, the front wall and the top wall having an contiguous opening therein for display of one or more articles contained within the enclosure, the container further including a slanted shelf extending from the edge adjacent the top and back walls to an area adjacent the edge between the front wall and the bottom wall, the shelf being integral along one side with one of the walls forming the enclosure.

Further features, objects and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
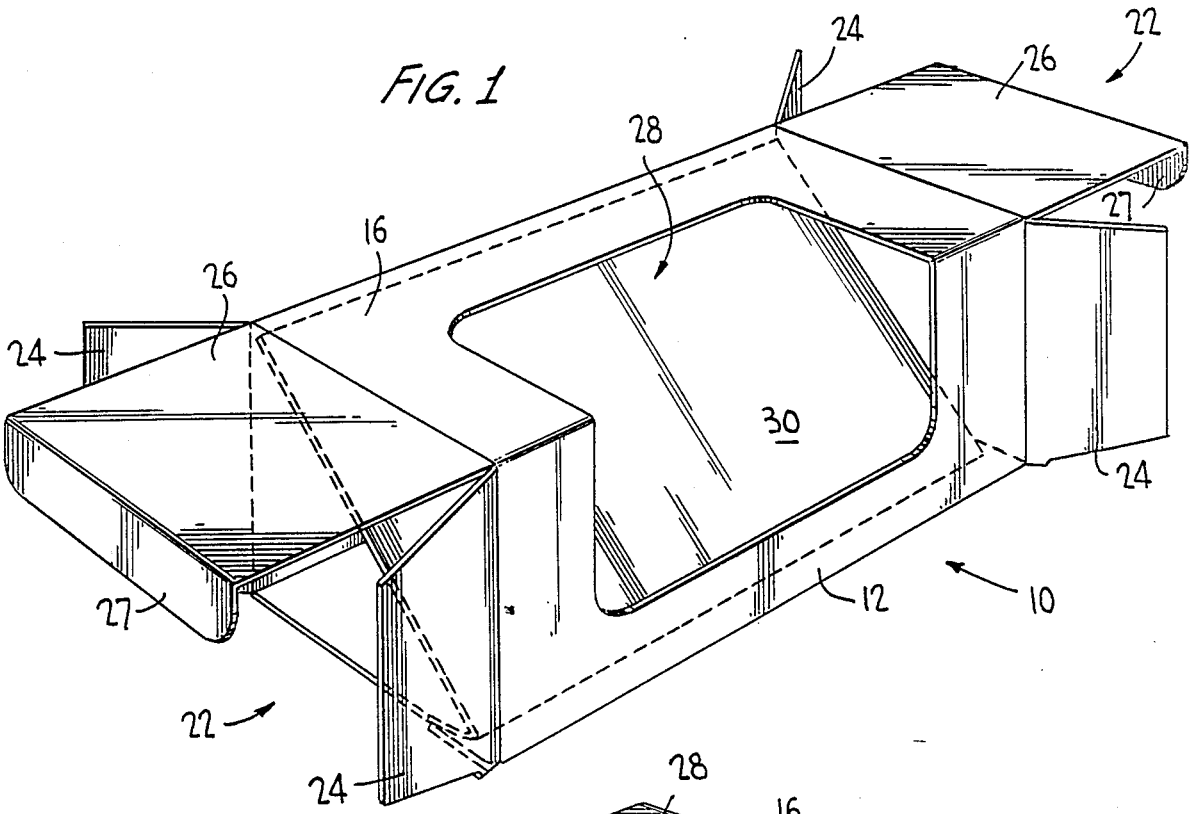
FIG. 1 is a perspective view of one embodiment of a packaging container according to the present invention, the container being shown with its end flaps in their open position for the purposes of clarity.
Figure 2:
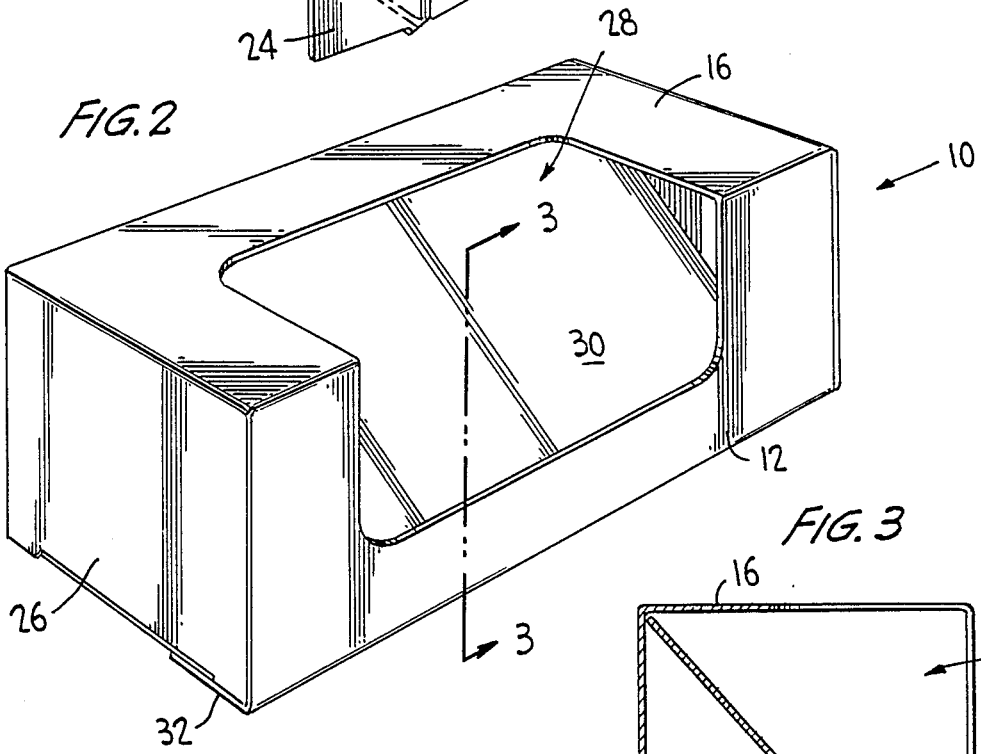
FIG. 2 is a perspective view of the packaging container of FIG. 1 with the end flaps being shown in their closed position such that the container is suitable for displaying an article contained within the packaging container as well as one or more non-displayed articles.
Figure 3:
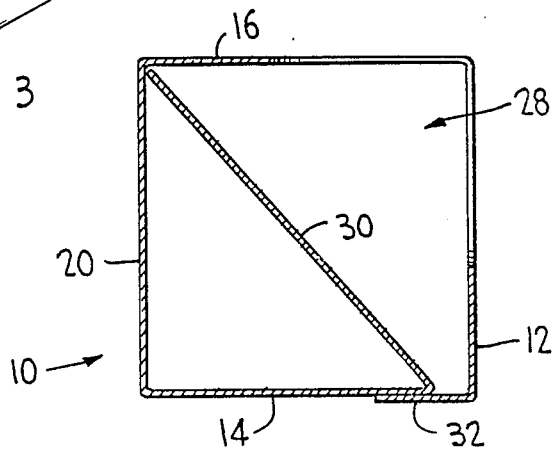
FIG. 3 is a cross-sectional view of the packaging container taken along line 3—3 of FIG. 2 which illustrates the angled or slanted article support or shelf enclosed within the packaging container.

Referring first to FIGS. 1 through 3, shown is one embodiment of a construction for a packaging container 10 in accordance with the present invention. Container 10 in this embodiment is of generally rectangular configuration and comprises front wall 12, bottom wall 14 (see FIG. 3), top wall 16 and rear wall 20 (see also FIG. 3). Closing the ends of packaging container 10 are end closures 22, each comprising two side flaps 24 and end wall 26, the side flaps adapted to be folded inwardly so as to be generally perpendicular to front wall 12 and rear wall 20. End walls 26 are adapted to be folded downwardly so as to be perpendicular with top wall 16 and bottom wall 14 with depending flange 27 of the end wall adapted to be inserted within container 10 so as to help end closure 22 to be maintained in a securely closed position.

Front wall 12 and top wall 16 are each provided with an interconnected or contiguous cut-out portion forming a window or opening 28 such that articles contained in package 10 can be easily viewed from the exterior. While opening 28 in the embodiment of packaging container 10 as shown is open or not covered, it is of course possible to cover the opening with a suitable sheet of transparent material which tends to enhance the overall appearance of the container and the article or articles displayed therein as well providing some additional measure of protection for the contained article or articles from damage, soiling from such as dust, pilferage and the like.

Provided within the interior of packaging container 10 is shelf or support 30. As is best shown in FIG. 3, shelf 30 extends diagonally or at an angle from top wall 16 and bottom wall 14, basically extending from the edge between the top wall and rear wall 20 to near the edge between front wall 12 and the bottom wall. Preferably, shelf 30 is of a dimension such that it extends from near one end closure 22 to the opposite end closure although it is contemplated that the shelf could be of lesser dimensions between the end closures if so desired.

In the embodiment of packaging container 10 as shown, shelf 30 is integral with bottom wall 14 and is folded upwardly to meet the edge between top wall 16 and rear wall 20 as is best illustrated in FIG. 3. Front wall 12 includes depending flange 32 extending generally parallel with bottom wall 14 and is secured thereto near the fold line between the bottom wall and shelf 30 by suitable means such as adhesives and the like.

While packaging container 10 can be used as a package in the marketing of a large variety of items so as to enhance their visual presentation at the point of sale, the container finds particular adaptability in the display of small items of personal effects such as footwear including shoes, slippers and the like. Preferably, when packaging container 10 is used for this purpose in displaying footwear such as slippers, one of the pair of slippers is positioned on top of shelf 30 such that it is visible through opening or window 28 and the other of the pair of slippers is hidden or concealed beneath the shelf. In the situation that opening 28 is not covered by a transparent sheet such that the upper article enclosed within container 10 could possibly be separated from the container, suitable hold-down means (not shown) such as a cord, elastic band or the like may be employed to secure the article to shelf 30 or some other portion of the container.

Figure 4:
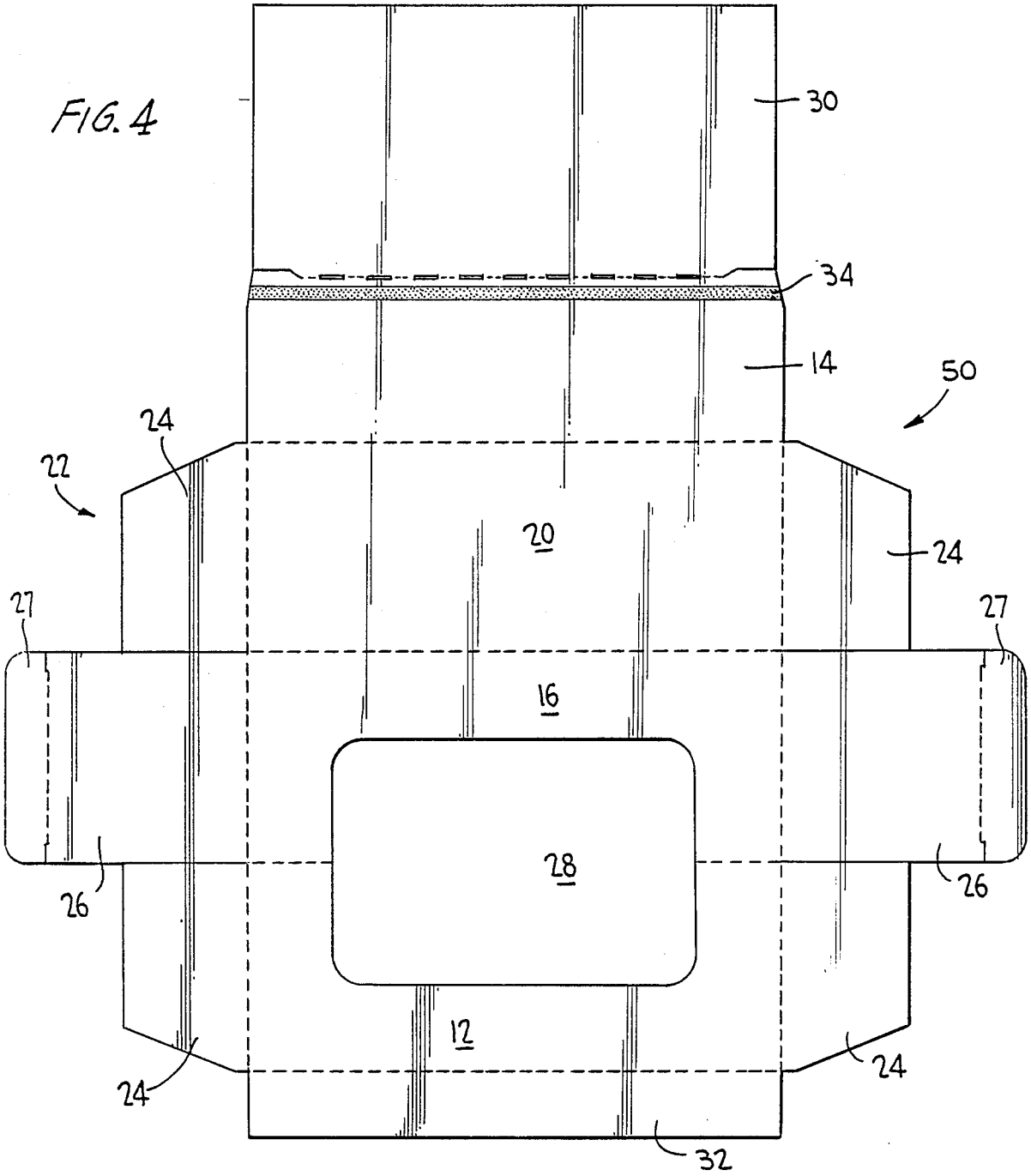
FIG. 4 is a plan of one embodiment for a blank suitable for constructing the packaging container shown in FIGS. 1 through 3.

Turning now to FIG. 4, shown is a preferred embodiment of a one-piece or integral blank 50 which may be used in forming packaging container 10 illustrated in the previous Figures. Blank 50 may be cut or diepunched from a sheet or web of suitable material such as fiberboard, pasteboard, cardboard and the like so as to have the configuration shown. The solid lines on blank 50 indicate slits or cuts through the web or sheet of material and the dashed lines indicate where the blank will be folded in assembling it into the packaging container 10. Fold lines in blank 50 can be formed by scoring, bending or other known methods. If included, a transparent sheet (not shown) may be applied over the cutout for window or opening 28 by suitable means such as adhesives, tape, melting by application of heat or similar methods known in the art.

Prior to forming blank 50 but preferably after the blank is formed from a sheet or web of suitable material, a line of adhesive 34 or other suitable adherent substance is applied to the end portion of bottom wall 14 which is to be adhered to extension 32 on front wall 12 as is best shown in FIG. 3. Alternatively, an adhesive or adhering means could be applied to extension 32 on front wall 12 to achieve essentially the same results as in the other method.

The assembly of package 10 from blank 50 is, as is apparent from FIG. 4, simply folding the blank first on the major fold lines (those that appear horizontal in the drawings) and then suitably fixing or securing bottom wall 14 to extension 32 of front wall 12. Thereafter, end closure 22 is completed by folding flaps 24 inwardly adjacent the near edge of shelf 30 and then closing end wall 26 against the flaps and inserting tab or flange 27 between the lower edges of the flaps and the upper surface of bottom wall 14.

As is apparent from the foregoing, packaging container 10 according to the invention provides an attractive and sturdy means for displaying articles so as to enhance their marketability while in the same container providing a measure of protection for the article or articles contained therein from incidental damage. A particular advantage of the packaging container of the present invention is is that the angled or diagonal interior shelf 30 allows the article contained therein to be displayed at an advantageous angle to emphasize various attributes of the article thereby further enhancing its overall presentation and thus its marketability. In addition, the space provided beneath shelf 30 provides a convenient storage space for other articles which may form a part of a pair or set with the article being displayed such that the concealed or non-displayed article is not separated from the other and is also protected from damage, soiling and pilferage.

While there has been shown and described what is considered to be preferred embodiments of the present invention, it will be apparent to those skilled in the art to which the invention pertains that various changes and modifications may be made therein without departing from the invention as defined in the appended claims.

It is claimed:

1. A packaging container comprising a front wall, a back wall, a top wall, a bottom wall and two end walls joined to each other to form an enclosure of a generally rectangular configuration, said front wall and said top wall having a contiguous opening therein for display of one or more articles contained within the enclosure, the container further including a slanted shelf extending from adjacent an edge between the top wall and the back wall to an area adjacent an edge between the front wall and the bottom wall, wherein the front wall includes an integral extension flange extending in a plane parallel to the bottom wall.

2. A packaging container in accordance with claim 1 wherein the shelf is integral with the bottom wall.

3. A packaging container in accordance with claim 1 wherein the extension flange of the front wall is secured to the bottom wall by an adhesive.

4. A packaging container in accordance with claim 1 having two end closures each end closure comprising a side flap extending from the front wall, a side flap extending from the rear wall, and an end wall.

5. A packaging container in accordance with claim 4 wherein each end wall includes a depending flange.

6. A packaging container in accordance with claim 4 wherein each end wall extends from one of the top wall and the bottom wall and is integral therewith.

7. A packaging container in accordance with claim 1 wherein the shelf extends basically the entire distance between the end closures.

8. A packaging container comprising a top wall, a bottom wall, a front wall and a back wall joined to each other to form an enclosure of a generally rectangular configuration, said front wall and said top wall having a contiguous opening therein for display of one or more articles contained within the enclosure, the container further including a slanted shelf extending from an edge adjacent the top and back walls to an area adjacent an edge between the front wall and the bottom wall, the shelf being integral along one side with one of the walls forming the enclosure, wherein the front wall includes an integral extension flange extending in a plane parallel to the bottom wall.

9. A packaging container in accordance with claim 8 further including two end closures each secured to at least one of the walls.

10. A packaging container in accordance with claim 9 wherein the front wall, top wall, rear wall, bottom wall, end closures and shelf are formed from an integral blank of material.

11. A packaging container in accordance with claim 10 wherein the shelf is integral with the bottom wall.

12. A packaging container in accordance with claim 8 wherein the extension flange of the front wall is secured to the bottom wall by an adhesive.

13. A packaging container in accordance with claim 9 wherein each end closure comprises a side flap extending from the one wall, a side flap extending from an opposite wall, and an end wall.

14. A packaging container in accordance with claim 13 wherein the side flaps and the end wall of each end closure are integral with the adjacent wall.

15. A packaging container in accordance with claim 13 wherein the end wall of each end closure includes a depending flange.

16. A packaging container in accordance with claim 14 wherein the end wall of each end closure extends from one of the top wall and the bottom wall and the side flaps of each end closure extend from the front wall and the back wall respectively.

17. A packaging container in accordance with claim 8 wherein the shelf extends basically the entire distance between the end closures.

* * * * *